US010319360B1

(12) United States Patent
He et al.

(10) Patent No.: US 10,319,360 B1
(45) Date of Patent: Jun. 11, 2019

(54) ACTIVE MASKING OF TONAL NOISE USING MOTOR-BASED ACOUSTIC GENERATOR TO IMPROVE SOUND QUALITY

(71) Applicant: GM GLOBAL TECHNOLOGY OPERATIONS LLC, Detroit, MI (US)

(72) Inventors: Song He, Troy, MI (US); Yo Chan Son, Rochester Hills, MI (US); Gilsu Choi, Shelby Township, MI (US); Caleb W. Secrest, Oakland Township, MI (US); Aja Anjilivelil, Troy, MI (US); Scott M. Reilly, Southfield, MI (US); John P. Miller, Howell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/913,412

(22) Filed: Mar. 6, 2018

(51) Int. Cl.
*G10K 11/175* (2006.01)

(52) U.S. Cl.
CPC ..... *G10K 11/175* (2013.01); *G10K 2210/51* (2013.01)

(58) Field of Classification Search
CPC ..... B64C 39/024; G03G 21/20; G06F 3/165; G10K 11/175; G10K 11/178; G10K 11/1782; H04L 7/0331; B60L 15/02; F01N 1/065
USPC ..... 15/326; 341/143; 375/295; 381/71.1, 381/71.11, 71.14, 71.3, 71.4, 73.1, 77, 86, 381/94.1, 162, 318; 399/1, 91; 415/1, 415/119; 417/44.1; 74/337.5; 180/443, 180/446; 318/432; 477/68; 700/73; 701/22, 42; 704/226
See application file for complete search history.

(56) References Cited

U.S. PATENT DOCUMENTS 5,245,385 A * 9/1993 Fukumizu ..... G03G 15/00 381/71.3
5,289,147 A * 2/1994 Koike ..... B41J 29/10 399/1
5,388,956 A * 2/1995 Pla ..... F04D 25/166 415/1
5,478,199 A * 12/1995 Gliebe ..... B64D 33/02 415/119
5,502,869 A * 4/1996 Smith ..... A47L 9/0081 15/326
5,638,454 A * 6/1997 Jones ..... G10K 11/178 381/71.14
5,652,799 A * 7/1997 Ross ..... G10K 11/178 381/71.11

(Continued)

OTHER PUBLICATIONS

U.S. Appl. No. 15/618,573, filed Jun. 9, 2017, entitled "Method and Apparatus for Acoustic Signal Generation."

(Continued)

*Primary Examiner* — Gerald Gauthier
(74) *Attorney, Agent, or Firm* — Lorenz & Kopf LLP

(57) ABSTRACT

In various embodiments, methods, systems, and vehicles are provided for masking a tonal noise of a motor. In certain embodiments, a vehicle includes a drive system and an active masking acoustic signal generator (AMAG). The drive system includes a motor generating a tonal noise. The AMAG is configured to at least facilitate masking the tonal noise, by introducing a complementary harmonic tone, injecting dithering into the motor, or both.

20 Claims, 8 Drawing Sheets

(56) References Cited

U.S. PATENT DOCUMENTS 5,692,054 A * 11/1997 Parrella ..... F04D 29/665 381/71.3
5,784,670 A * 7/1998 Sasahara ..... B41J 29/38 381/73.1
6,006,054 A * 12/1999 Wong ..... G03G 15/0291 250/324
6,980,145 B1 * 12/2005 Tammineedi ..... H03M 3/33 341/131
8,212,505 B2 7/2012 Nagashima et al.
8,223,985 B2 * 7/2012 Loud ..... G10K 11/175 381/71.4
9,271,073 B2 2/2016 Valeri et al.
9,344,271 B1 * 5/2016 Dusatko ..... H04L 7/0331
9,395,689 B2 * 7/2016 Mae ..... G03G 21/20
9,415,870 B1 * 8/2016 Beckman ..... B64C 39/024
10,224,017 B2 * 3/2019 Lee ..... G10K 11/178
2003/0152161 A1 * 8/2003 Lambert ..... H03M 7/3008 375/295
2004/0114768 A1 * 6/2004 Luo ..... G10K 11/178 381/71.4
2006/0018764 A1 * 1/2006 Schnetzka ..... F04C 28/08 417/44.1
2010/0266138 A1 * 10/2010 Sachau ..... H04S 3/00 381/73.1
2011/0142250 A1 * 6/2011 Schmale ..... G01R 33/288 381/73.1
2012/0300954 A1 * 11/2012 Ku ..... G10K 11/175 381/71.1
2015/0063582 A1 * 3/2015 Pan ..... G10K 11/178 381/71.4
2015/0131808 A1 * 5/2015 Lennstrom ..... G10K 11/175 381/73.1
2015/0139442 A1 * 5/2015 Kreifeldt ..... B60Q 5/008 381/86
2017/0123754 A1 * 5/2017 Kwon ..... G05B 15/02

OTHER PUBLICATIONS

Muhlethaler, J., et al. "Acoustic Noise in Inductive Power Components", ABB Switzerland, Ltd., Power Electronic Systems Laboratory, published in Switzerland, 8 pages.

* cited by examiner

ACTIVE MASKING OF TONAL NOISE USING MOTOR-BASED ACOUSTIC GENERATOR TO IMPROVE SOUND QUALITY

TECHNICAL FIELD

The present disclosure generally relates to vehicles, and more particularly relates to methods and systems for masking tonal noise in vehicles, particularly in electric or hybrid electric vehicles having an electric motor.

INTRODUCTION

Drivers and other occupants of vehicles may have a desire to hear vehicle noises in a certain manner, for example with an improved sound quality with respect to certain types of tonal noises that may be experienced within a vehicle. In particular, certain electric vehicles have highly tonal noise sources from electric motor(s) and transmission gears, while the overall masking noise level is low due to a lack of engine noise (for battery electric vehicles or hybrid vehicles operating at Electric Vehicle mode). This may raise tonal noise concerns, which may adversely affect the noise quality or acoustic rating of electric vehicle.

Accordingly, it is desirable to provide techniques for masking potentially unpleasant tonal electric vehicle sounds. It is also desirable to provide methods, systems, and vehicles utilizing such techniques. Furthermore, other desirable features and characteristics will become apparent from the subsequent detailed description of exemplary embodiments and the appended claims, taken in conjunction with the accompanying drawings.

SUMMARY

In accordance with certain exemplary embodiments, a method is provided that includes: identifying a tonal noise of a motor; and masking the tonal noise, by introducing a complementary harmonic tone, injecting dithering into the motor, or both, using the motor as a speaker to create the complementary tone, the dithering, or both.

Also in certain embodiments, the step of masking the tonal noise includes masking the tonal noise, by injecting dithering into the motor.

Also in certain embodiments, the step of injecting dithering into the motor includes:

injecting dithering into the motor, thereby increasing a noise floor for the motor and decreasing a tone-to-noise ratio for the motor.

Also in certain embodiments, the step of masking the tonal noise includes introducing a complementary harmonic control signal voltage for the motor.

Also in certain embodiments, the step of introducing a complementary harmonic tone includes introducing a complementary harmonic tone for the motor, wherein the complementary harmonic tone includes a low-order harmonic tone that enriches a complexity of the tonal noise of the motor.

Also in certain embodiments, the step of introducing a complementary harmonic tone includes introducing a low order harmonic tone with respect to the tonal noise of the motor.

Also in certain embodiments, the method further includes incrementing a sound pitch for the tonal noise as a function of motor speed.

Also in certain embodiments, the method further includes incrementing a sound pitch for the tonal noise as a function of motor torque.

Also in certain embodiments, the motor includes an electric motor; and the method is implemented as part of an electric vehicle or hybrid electric vehicle.

In certain other embodiments, a system includes a motor and an active masking acoustic signal generator (AMAG). The motor generates a tonal noise. The active masking acoustic signal generator (AMAG) is configured to at least facilitate masking the tonal noise, by introducing a complementary harmonic tone, injecting dithering into the motor, or both.

Also in certain embodiments, the AMAG is configured to at least facilitate masking the tonal noise by injecting dithering into the motor.

Also in certain embodiments, the AMAG is configured to at least facilitate masking the tonal noise by introducing a complementary harmonic tone for the motor.

Also in certain embodiments, the AMAG is configured to at least facilitate masking the tonal noise by injecting dithering into the motor; and introducing a complementary harmonic tone for the motor.

Also in certain embodiments, the motor includes an electric motor; and the system is implemented as part of an electric vehicle or hybrid electric vehicle.

In certain other embodiments, a vehicle includes a drive system and an active masking acoustic signal generator (AMAG). The drive system includes a motor generating a tonal noise. The AMAG is configured to at least facilitate masking the tonal noise, by introducing a complementary harmonic tone, injecting dithering into the motor, or both Also in certain embodiments, the AMAG is configured to at least facilitate masking the tonal noise by injecting dithering into the motor.

Also in certain embodiments, the AMAG is configured to at least facilitate masking the tonal noise by introducing a complementary harmonic tone for the motor.

Also in certain embodiments, the AMAG is configured to at least facilitate masking the tonal noise by injecting dithering into the motor; and introducing a complementary harmonic tone for the motor.

Also in certain embodiments, the motor includes an electric motor; and the vehicle includes an electric vehicle or hybrid electric vehicle.

Also in certain embodiments, the AMAG includes a processor onboard the vehicle; and the vehicle further includes a sensor array that is configured to at least facilitate identifying the tonal noise of the motor.

DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the disclosure or the application and uses thereof. Furthermore, there is no intention to be bound by any theory presented in the preceding background or the following detailed description.

Figure 1:
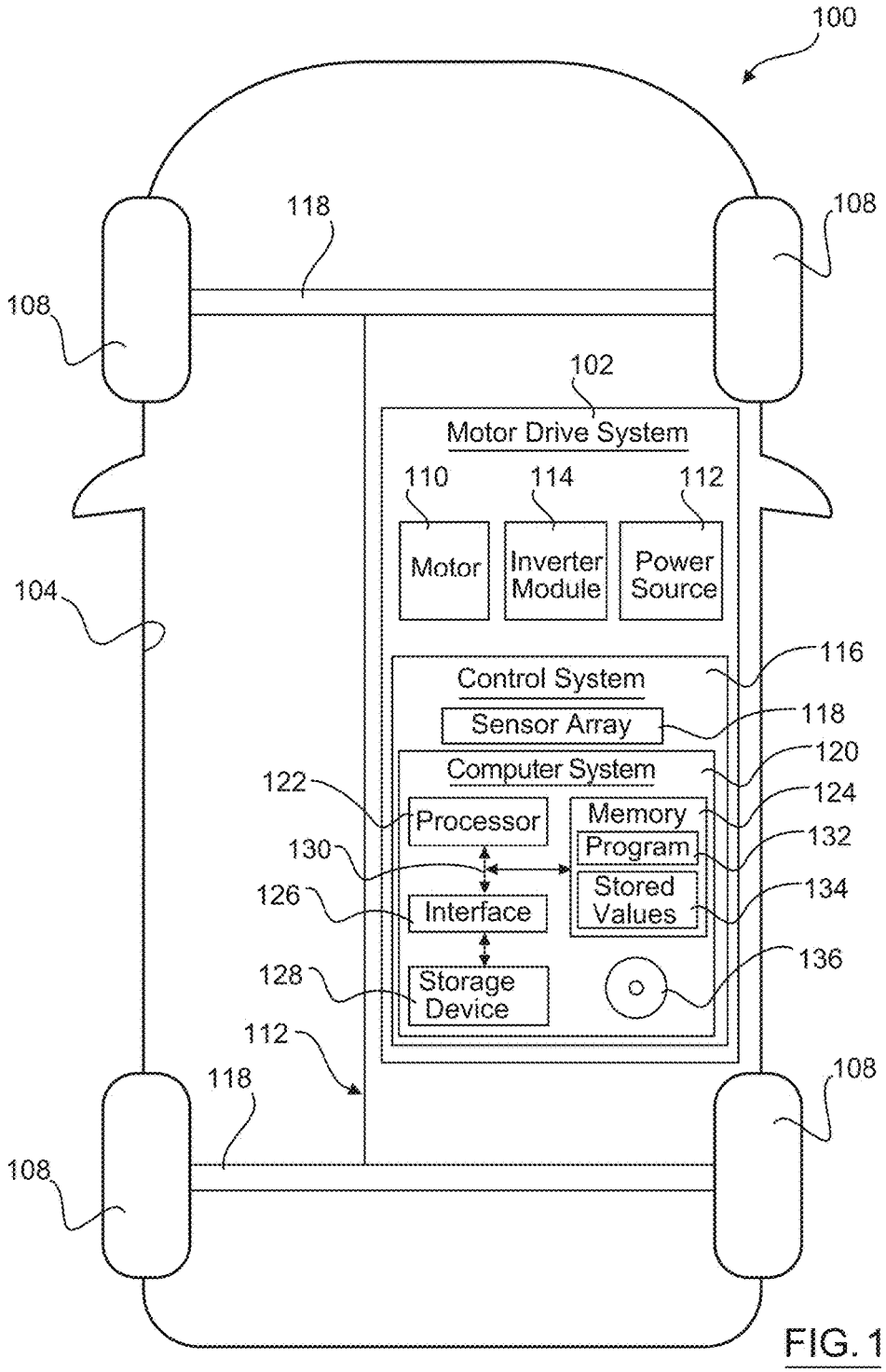
FIG. 1 is a functional block diagram of a vehicle that includes a motor drive system for masking vehicle sound, in accordance with exemplary embodiments.

FIG. 1 illustrates a vehicle 100, or automobile, according to an exemplary embodiment. The vehicle 100 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD), and/or other types of vehicles and/or mobile platforms (e.g., aircraft, spacecraft, watercraft, locomotive, train, personal movement apparatus, robot, and so on).

Figure 7:
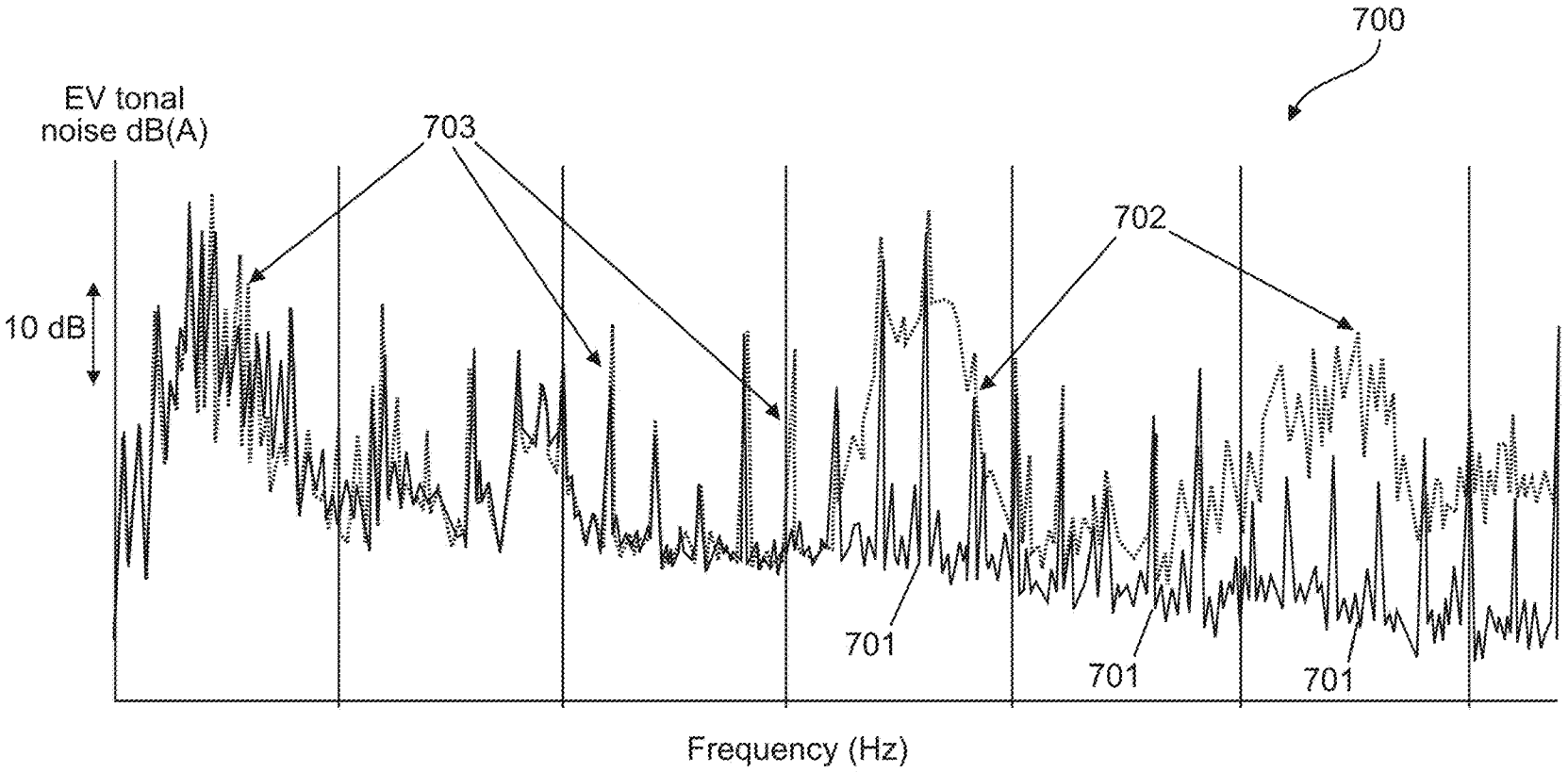
Figure 8:
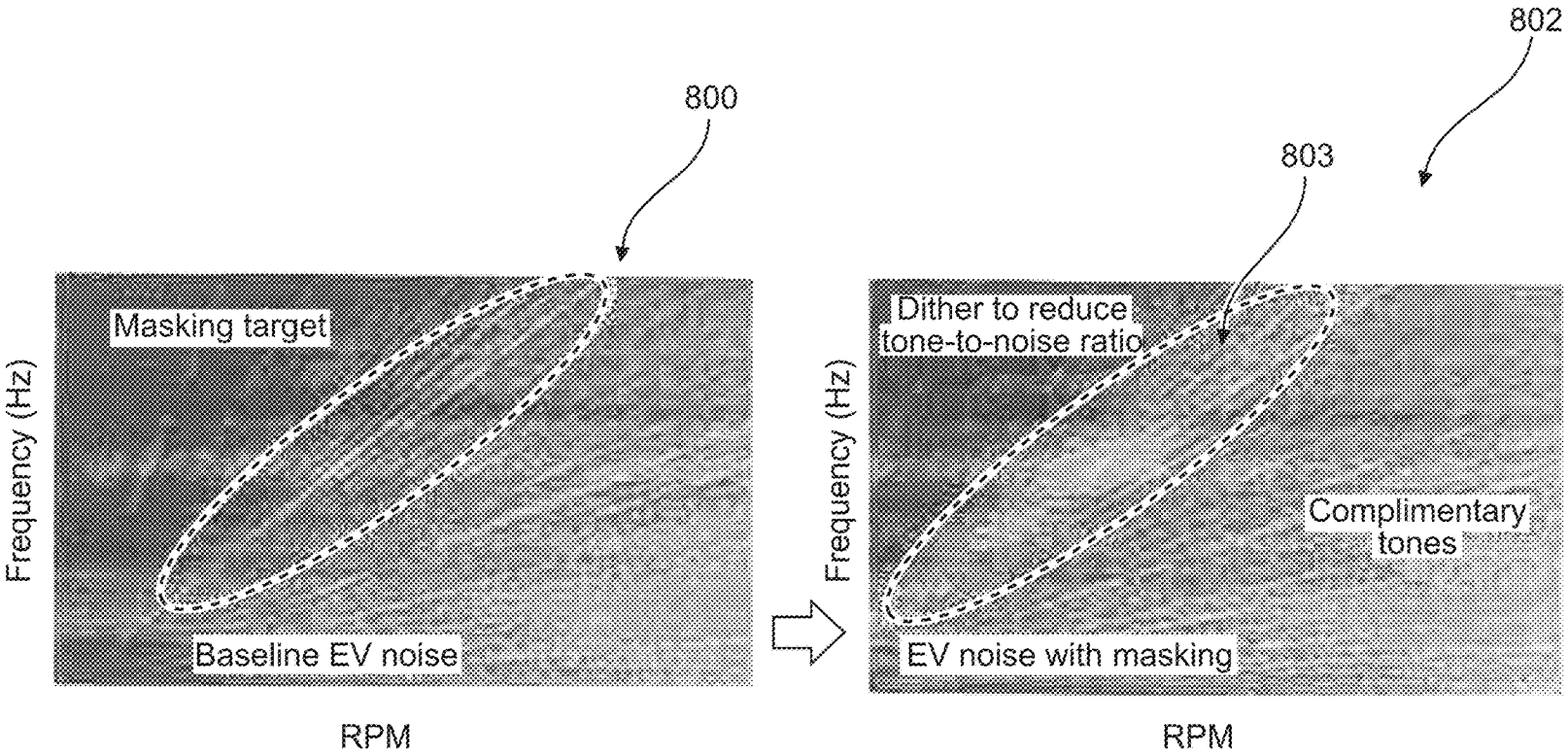
FIG. 8 provides a graphical representation of exemplary test results using sound masking utilizing the techniques of the motor drive system and vehicle of FIG. 1, in accordance with exemplary embodiments, for sound masking when the electric motor is operating over a run-up transient event corresponding to a vehicle drive-away condition.

While the motor drive system 102 is depicted in FIG. 1 as being part of the vehicle 100, it will be appreciated that in other embodiments the drive system 102 may be a stand-alone system, and/or may be part of one or more other systems, separate from or in addition to any vehicles. Additional details of the motor drive system 102 are depicted in FIGS. 7 and 8 and described in detail further below in connection therewith. The motor drive system 102 as depicted in FIGS. 1, 7, and 8 and described herein may be implemented in various embodiments as a stand-alone system and/or in connection with any number of vehicles, mobile platforms, and/or other systems.

As described in greater detail further below in connection with the example of a vehicle 100 of FIG. 1, the vehicle 100 includes a motor drive system 102 for masking vehicle sound. In various embodiments, the motor drive system 102 masks vehicle sound in accordance with the steps set forth further below in connection with the process 400 of FIG. 4 and the exemplary implementations of FIGS. 2-8, also discussed further below.

In various embodiments, as depicted in FIG. 1, vehicle 100 also includes, in addition to the above-referenced motor drive system 102, a body 104, a chassis 106, and four wheels 108. The body 104 is arranged on the chassis 106 and substantially encloses the other components of the vehicle 100. The body 104 and the chassis 106 may jointly form a frame. The wheels 108 are each rotationally coupled to the chassis 106 near a respective corner of the body 104. In various embodiments, the vehicle 100 may differ from that depicted in FIG. 1. For example, in certain embodiments the number of wheels 108 may vary.

In various embodiments, the motor drive system 102 is disposed within the body 104 of the vehicle 100, and is mounted on the chassis 106. As depicted in FIG. 1 discussed further below, in various embodiments, the motor drive system 102 includes a motor 110, a power source 112, an inverter module 114, and a control system 116.

In various embodiments, the motor 110 includes one or more electric motors. In certain embodiments, the motor 110 may include one or more other types of motors (e.g., gas combustion engines). Also in various embodiments, the motor 110 is utilized as part of a powertrain and/or actuator assembly for powering movement of the vehicle 100, for example by powering one or more wheels 108 of the vehicle 100 via engagement of one or more drive shafts (e.g., axles) 118 of the vehicle 100.

Also in various embodiments, the power source 112 includes one or more vehicle batteries, direct current (DC) power sources, and/or other vehicle power sources. In addition, in various embodiments, the inverter module 114 receives direct current from the power source 112, and converts the direct current to alternating current (AC) for use by the motor 110.

In various embodiments, the control system 116 controls operation of the motor drive system 102, including operation of the motor 110 thereof. In addition, in various embodiments, the control system 116 provides masking for certain vehicle sounds through the control of the motor 110, for example in accordance with the steps set forth further below in connection with the process 400 of FIG. 4 and the exemplary implementations of FIGS. 3-8, also discussed further below.

As depicted in FIG. 1, the control system 116 comprises a sensor array 118 and a computer system 120. In various embodiments, the sensor array 118 includes one or more sensors (e.g., voltage sensors, current sensors, motor position sensors, and/or other sensors) for use in controlling the motor 110 and/or other components of the motor drive system 102. In the depicted embodiment, the computer system 120 of the control system 116 includes a processor 122, a memory 124, an interface 126, a storage device 128, and a bus 130. The processor 122 performs the computation and control functions of the control system 116, and may comprise any type of processor or multiple processors, single integrated circuits such as a microprocessor, or any suitable number of integrated circuit devices and/or circuit boards working in cooperation to accomplish the functions of a processing unit. During operation, the processor 122 executes one or more programs 132 contained within the memory 124 and, as such, controls the general operation of the control system 116 and the computer system of the control system 116, generally in executing the processes described herein, such as the process 400 described further below in connection with FIG. 4 and the exemplary implementations of FIGS. 5-8.

The memory 124 can be any type of suitable memory. For example, the memory 124 may include various types of dynamic random access memory (DRAM) such as SDRAM, the various types of static RAM (SRAM), and the various types of non-volatile memory (PROM, EPROM, and flash). In certain examples, the memory 124 is located on and/or co-located on the same computer chip as the processor 122. In the depicted embodiment, the memory 124 stores the above-referenced program 132 along with one or more stored values 134.

The bus 130 serves to transmit programs, data, status and other information or signals between the various components of the computer system of the control system 116. The interface 126 allows communication to the computer system of the control system 116, for example from a system driver and/or another computer system, and can be implemented using any suitable method and apparatus. In one embodiment, the interface 126 obtains the various data from the sensors of the sensor array 104. The interface 126 can include one or more network interfaces to communicate with other systems or components. The interface 126 may also include one or more network interfaces to communicate with technicians, and/or one or more storage interfaces to connect to storage apparatuses, such as the storage device 128.

The storage device 128 can be any suitable type of storage apparatus, including direct access storage devices such as hard disk drives, flash systems, floppy disk drives and optical disk drives. In one exemplary embodiment, the storage device 128 comprises a program product from which memory 124 can receive a program 132 that executes one or more embodiments of one or more processes of the present disclosure, such as the steps of the process 400 (and any sub-processes thereof) described further below in connection with FIG. 4 and the exemplary implementations of FIGS. 3-8. In another exemplary embodiment, the program product may be directly stored in and/or otherwise accessed by the memory 124 and/or a disk (e.g., disk 136), such as that referenced below.

The bus 130 can be any suitable physical or logical means of connecting computer systems and components. This includes, but is not limited to, direct hard-wired connections, fiber optics, infrared and wireless bus technologies. During operation, the program 132 is stored in the memory 124 and executed by the processor 122.

It will be appreciated that while this exemplary embodiment is described in the context of a fully functioning computer system, those skilled in the art will recognize that the mechanisms of the present disclosure are capable of being distributed as a program product with one or more types of non-transitory computer-readable signal bearing media used to store the program and the instructions thereof and carry out the distribution thereof, such as a non-transitory computer readable medium bearing the program and containing computer instructions stored therein for causing a computer processor (such as the processor 122) to perform and execute the program. Such a program product may take a variety of forms, and the present disclosure applies equally regardless of the particular type of computer-readable signal bearing media used to carry out the distribution. Examples of signal bearing media include: recordable media such as floppy disks, hard drives, memory cards and optical disks, and transmission media such as digital and analog communication links. It will be appreciated that cloud-based storage and/or other techniques may also be utilized in certain embodiments. It will similarly be appreciated that the computer system of the control system 116 may also otherwise differ from the embodiment depicted in FIG. 1, for example in that the computer system of the control system 116 may be coupled to or may otherwise utilize one or more remote computer systems and/or other systems.

Figure 2:
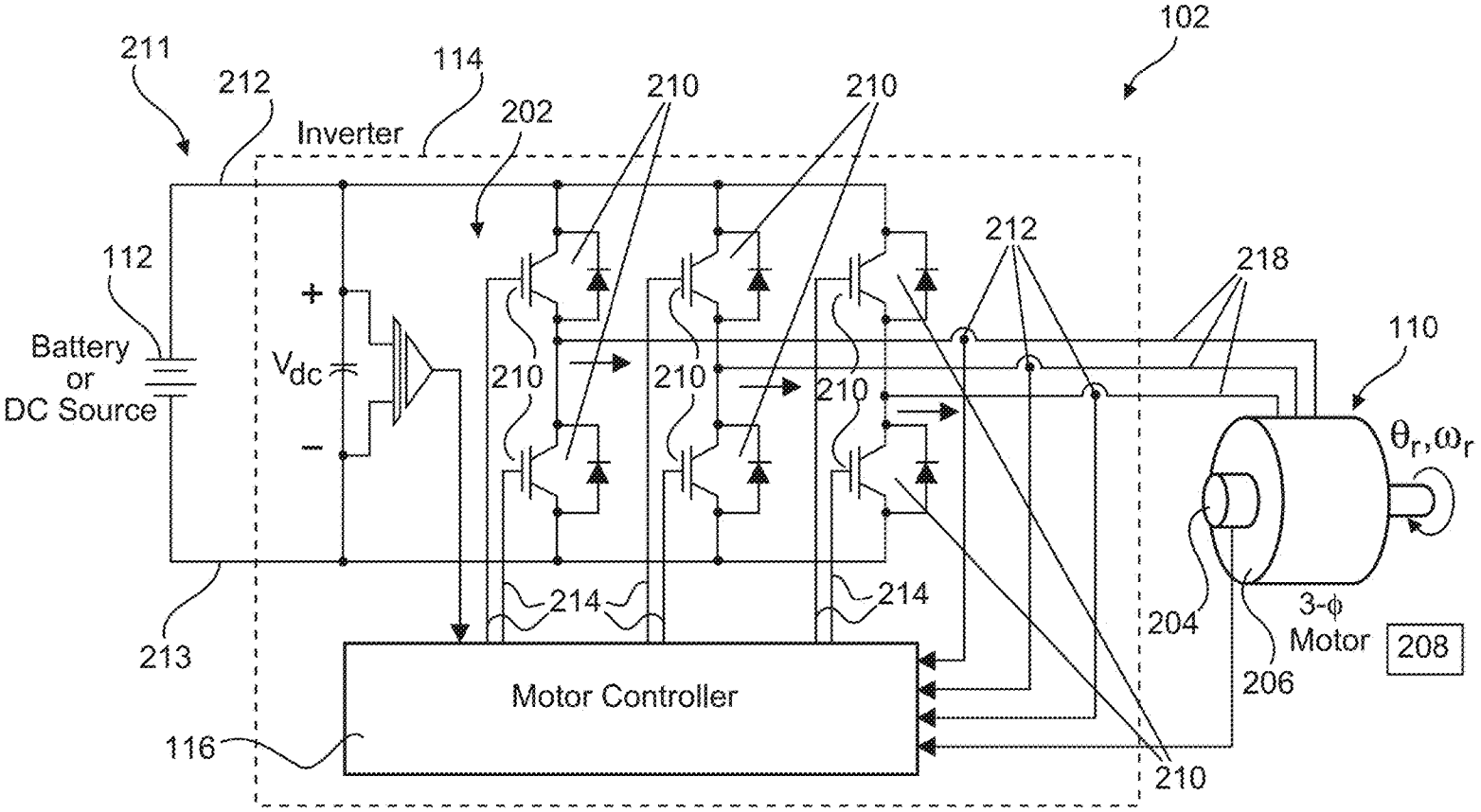
FIG. 2 provides a functional diagram of the motor drive system of the vehicle of FIG. 1, in accordance with exemplary embodiments.

FIG. 2 provides a functional diagram of the motor drive system 102 of the vehicle 100 of FIG. 1, in accordance with exemplary embodiments. Specifically, in various embodiments, FIG. 2 shows a three-phase AC motor drive system 102 using the inverter from a DC power supply as the power source 112. In various embodiments, the control system 116 uses the motor position $\theta_r$ and speed $\omega_r$, and synthesize the output voltage using the IGBT input $S_{ap}$~$S_{cn}$ (for example, as discussed further below) to control the output current $i_a$, $i_b$ and $i_c$ in order to deliver the function such as torque generation or speed control. As noted above, in various embodiments, the motor drive system 102 may be implemented in various embodiments as a stand-alone system and/or in connection with any number of vehicles, mobile platforms, and/or other systems.

With continued reference to FIG. 2, in various embodiments the motor drive system 102 comprises a multi-phase electric motor drive system. Also in various embodiments, the motor drive system 102 comprises the motor 110, power source 112, inverter module 114, and control system 116 of FIG. 1. Also in various embodiments, the inverter module 114 is disposed between the power source 112 (e.g., a direct current (DC) power source) and the motor 110. In certain embodiments, the inverter module 114 includes the control system 116 (in whole or in part), along with an inverter power circuit 202, which can be collocated in a single package in certain embodiments.

In various embodiments, the motor 110 may be configured as a three-phase permanent magnet device that includes a rotor 204 that is disposed within a stator 206. Also in certain embodiments, one or more position sensors 208 (e.g., of the sensor array 118 of FIG. 1) may be utilized to monitor a rotational position $\theta_r$ and rotational speed $\omega_r$ of the rotor 204. In various embodiments, the position sensors 208 may be physically part of, and/or physically separate from, the control system 116. In certain embodiments, the position sensors 208 comprise one or more Hall effect sensors. In certain other embodiments, the position and/or speed may be monitored via one or more other types of sensors (e.g., of the sensor array 118 of FIG. 1), and/or from a resolver of the motor 110, and/or from one or more motor commands (e.g., as may be obtained via the processor 122 of FIG. 1).

In various embodiments, the power source 112 is electrically connected to the inverter power circuit 202 via a high-voltage bus 211. In certain embodiments, the high-voltage bus 211 includes a positive high-voltage bus link (HV+) 212 and a negative high-voltage bus link (HV− 213. In certain embodiments, a voltage sensor 216 (e.g., which may be part of the sensor array 121 of FIG. 1 in certain embodiments) monitors electric potential across positive high voltage bus link 212 and negative high voltage bus link 213.

In various embodiments, various power conductors 218 are utilized to electrically connect the power source 112 to the inverter power circuit 202 via the high-voltage DC bus 211. Also in various embodiments, in this manner high-voltage DC electric power is transferred from the power source 112 to the motor 110 via the power conductors 218 in response to control signals provided by the control system 116.

In various embodiments, the inverter power circuit 202 includes various control circuits, such as power transistors 210 (e.g., paired power transistors 210, such as Integrated Gate Bipolar Transistors (IGBTs)) for transforming high-voltage direct current (DC) electric power to high-voltage alternating current (AC) electric power and transforming high-voltage AC electric power to high-voltage DC electric power. Also in various embodiments, the power transistors 210 of the inverter module 114 are electrically connected to the motor 110 via the power conductors 218. In addition, in various embodiments, one or more current sensors 212 (e.g., which may be part of the sensor array 118 of FIG. 1 in certain embodiments) are disposed to monitor electrical current in each of the power conductors. In certain embodiments, the inverter power circuit 202 and control system 116 are configured as a three-phase voltage-source pulse width modulated (PWM) converter that can operate in either a linear mode or a non-linear mode.

In certain embodiments, the control system 116 controls the power transistors 210 of the inverter power circuit 202 to convert stored DC electric power originating in the power source 112 to AC electric power to drive the motor 110 to generate torque. Similarly, the control system 116 can control the power transistors 210 of the inverter power circuit 202 to convert mechanical power transferred to the motor 110 to DC electric power to generate electric energy that is storable in the DC power source 20, including as part of a regenerative control strategy. The control system 116 can control the power transistors 210 employing linear and/or non-linear pulse width modulating (PWM) control strategies.

In certain embodiments, the control system 116 receives motor control commands and controls inverter states of the inverter power circuit 202 to provide motor drive and regenerative power functionalities. Signal inputs from the position sensor 208, the power conductors 218 and the voltage sensor 35 are monitored by the control system 116. The control system 116 communicates via control lines 214 to individual ones of the power transistors 210 of the inverter power circuit 202. The control system 116 includes control circuits, algorithms and other control elements to generate transistor control inputs $S_{ap}$~$S_{cn}$ which are communicated via the control lines 214 to the power transistors 210 of the inverter power circuit 202. The power transistors 210 control the output currents $i_a$, $i_b$ and $i_c$, which are transferred via the power conductors 218 to the motor 110 to generate power in the form of torque and/or rotational speed based upon the motor position $\theta_r$ and speed $\omega_r$.

Also in various embodiments, the control system 116 receives and implements motor control commands in a manner that masks vehicle sound in accordance with the steps set forth further below in connection with the process 400 of FIG. 4 and the exemplary implementations of FIGS. 3-8, also discussed below.

Figure 3:
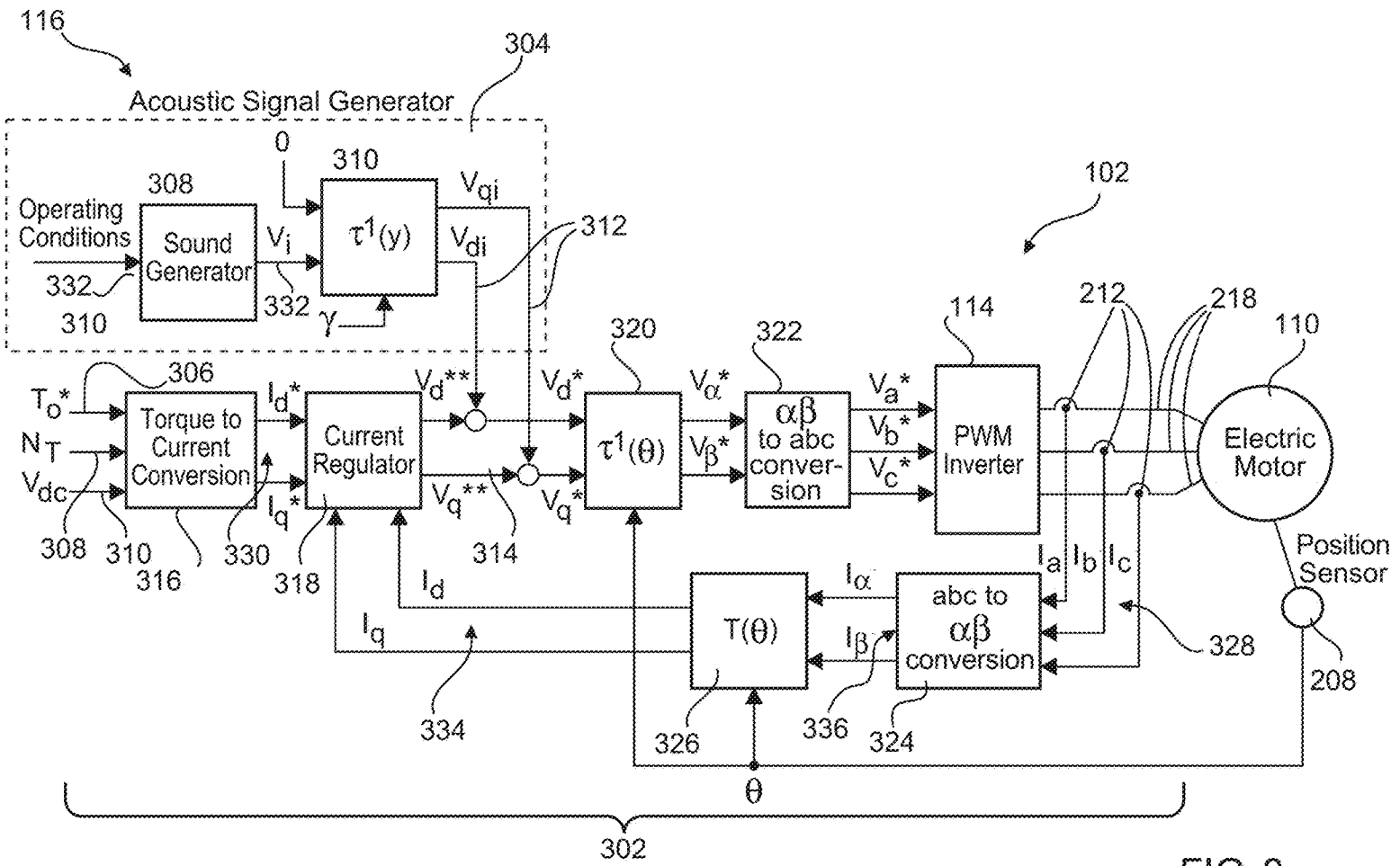
FIG. 3 provides a functional diagram of an exemplary implementation of a motor-based acoustic signal generator in the motor drive system of FIG. 2, in accordance with exemplary embodiments.

FIG. 3 schematically shows an embodiment of the motor controller 116 and inverter power circuit 114 of FIG. 2, which control operation of the electric motor of FIGS. 1 and 2, in various embodiments. As depicted in various embodiments, the motor controller 116 includes a first controller 302 and an acoustic signal generator 304, which combine to generate input signals Vdi and Vqi that are converted to the transistor control inputs $S_{ap}$~$S_{cn}$ 270 of FIG. 2 to control the power transistors 210 of the inverter power circuit 114 of FIG. 2.

The first controller 302 generates commands to control operation of the electric motor 110 based upon operating conditions, such as a torque command 306, motor speed 308, electrical potential 310, and/or other operating conditions.

The acoustic signal generator 304 generates a control output that injects an acoustic sound element in the form of a sound injection voltage 312 into the first controller 302. In various embodiments, the acoustic signal generator 304 comprises a sound pattern generator 308 that generates an instantaneous audio signal $V_i$ 332, and a rotational transformation element 310.

In various embodiments, the acoustic signal generator 304 can be in the form of a dedicated hardware circuit, an algorithm or another suitable form. The sound injection voltages 312 from the acoustic signal generator 304 and the initial output voltages $V_d$ and $V_q$ 314 combine to form voltage signals for controlling the motor output voltage that controls the electric motor 110 to generate a suitable acoustic signal coincident with generating and controlling torque and/or speed, and that marks certain tonal sounds, for example in accordance with the process 400 described further below. As employed herein, the term 'sound' refers to audible acoustic sound.

In various embodiments, the first controller 302 comprises a torque-to-current converter 316, a current regulator 318, an inverse Park transformation operation $T^{-1}(\theta)$ (dq-αβ) 320, an inverse Clarke transformation (αβ-abc) operation 322, a Clarke transformation operation (abc-αβ) 324, and a Park transformation operation T(θ) (αβ-dq) 326.

The torque-to-current converter 316 converts the torque command 306 into a pair of current commands $i_d$* and $i_q$* 330, which are input to the current regulator 318. Monitored 3-phase AC currents from the power conductors 218, i.e., $i_a$, $i_b$ and is 328 are reduced to stationary reference frame currents in the form of a pair of sinusoidal currents $i_\alpha$ and $i_\beta$ 336 by the Clarke transformation operation (abc-αβ) 324, and then transformed into currents $i_d$ and $i_q$ 334 by the Park transformation operation T(θ) (αβ-dq) 326 in the rotating reference domain using the motor position and motor speed information from the position sensor 208. The current regulator 318 uses the pair of current commands $i_d$* and $i_q$* 330 from the torque-to-current converter 316 and feedback from the Park transformation operation T(θ) (αβ-dq) 326 to generate a pair of initial output voltages $V_d$ and $V_q$ 314 for operating the electric motor 110 to generate torque.

The acoustic signal generator 304 is composed of a sound pattern generator 308 that generates an instantaneous audio signal $V_i$ 332, and a rotational transformation element 310 that generates sound injection voltages $V_{di}$ and $V_{qi}$ 312 based upon the instantaneous audio signal $V_i$ 332. The term 'generator' as employed in the terms 'acoustic signal generator' and 'sound pattern generator' can include hardware, software, and/or firmware components that have been configured to perform the associated specified functions that have been described. The sound injection voltages $V_{di}$ and $V_{qi}$ 312 are injected to the initial output voltages $V_d$ and $V_q$ 314 for operating the electric motor 110 to generate torque. The instantaneous audio signal $V_i$ 332 from the sound pattern generator 308 is generated and decomposed by the rotational transformation element 310 so as to vary the sound injection. The rotational transformation 310 is executed to locate the sound injection voltages $V_{di}$ and $V_{qi}$ 312 into the correct angular location γ in the electromagnetic circuit of the electric motor 110, and can be expressed as follows:

$$\begin{bmatrix} V_{di} \\ V_{qi} \end{bmatrix} = \begin{bmatrix} \cos\gamma & -\sin\gamma \\ \sin\gamma & \cos\gamma \end{bmatrix} \begin{bmatrix} 0 \\ V_i \end{bmatrix} = \begin{bmatrix} -V_i\sin\gamma \\ V_i\cos\gamma \end{bmatrix} \quad [1]$$

wherein γ represents the correct angular location.

The sound injection voltages $V_{di}$ and $V_{qi}$ 312 are added to the initial output voltages $V_d$ and $V_q$ 314 that are output from the current regulator 318 to generate the signal that is input to the inverse rotational transformation operation $T^{-1}(\theta)$ (dq-αβ) 320, i.e., $V_d$* and $V_q$*. As such, the sound injection voltages $V_{di}$ and $V_{qi}$ 312 are added to the corresponding initial output voltages $V_d$ and $V_q$ 314 of the current regulator 318 of the motor controller 116. The combination of the initial output voltages 314 and the sound injection voltages 312, i.e., $V_d$*=$V_d$**+$V_{di}$ and $V_q$*=$V_q$**+$V_{qi}$ are inverse-transformed back to the stationary reference frame voltage commands $V_\alpha$* and $V_\beta$* 126 in the inverse rotational transformation operation $T^{-1}(\theta)$ (dq-αβ) 320 using the position information from the position sensor 208.

The stationary reference frame voltage commands $V_\alpha$* and $V_\beta$* 126 are decomposed into output voltage commands $V_a$, $V_b$ and $V_c$ 171 in the inverse Clarke transformation (αβ-abc) operation 322, and finally converted to the transistor control inputs $S_{ap}$~$S_{cn}$ 270, which are communicated via the control lines 214 to the power transistors 210 of the inverter power circuit 114 to cause the electric motor 110 to generate audible acoustic sound, wherein the audible acoustic sound can be sensed by a pedestrian when the electric motor 110 is employed on an electric vehicle application.

Accordingly, in various embodiments, the control of the 3-phase AC motor is composed of elements 316, 318, 320, 322, and 114 of FIG. 3; depending on the operating condition (torque command $T_e$*, motor speed $N_r$ and the inverter input voltage $V_{dc}$), the torque conversion unit 316 converts the torque command into a pair of current commands $i_d$* and $i_q$* for the current regulator 318. Also in various embodiments, 3-phase AC currents ($i_a$, $i_b$ and $i_c$ from 328) are reduced to a pair of sinusoidal current $i_\alpha$ and $i_\beta$ (called as stationary reference frame currents) in conversion unit 324, and then transformed into $i_d$ and $i_q$ by transformation unit 326 in the rotating reference domain using the motor position and speed information from the sensor 208. The current regulator 318 uses the current command from the torque conversion unit 316 and feedback from the transformation unit 326 to make a pair of output voltages $V_d$ and $V_q$ for the motor. Without a new function, output voltages $V_d$*=$V_d$** and $V_q$*=$V_q$**are inverse-transformed back to the stationary reference frame voltage $V_\alpha$* and $V_\beta$* in 320 using the position information from 208. Then they are decomposed into $V_a$, $V_b$ and $V_c$ in conversion box 322, and finally converted to the IGBT command $S_{ap}$~$S_{cn}$ of FIG. 2, which are communicated via the control lines 214 to the power transistors 210 of the inverter power circuit 114 to cause the electric motor 110 to generate audible acoustic sound, including the desired masking for the tonal motor sound, for example as discussed in greater detail further below in connection with the process 400 of FIG. 4 and the exemplary implementations of FIGS. 5-8.

Figure 4:
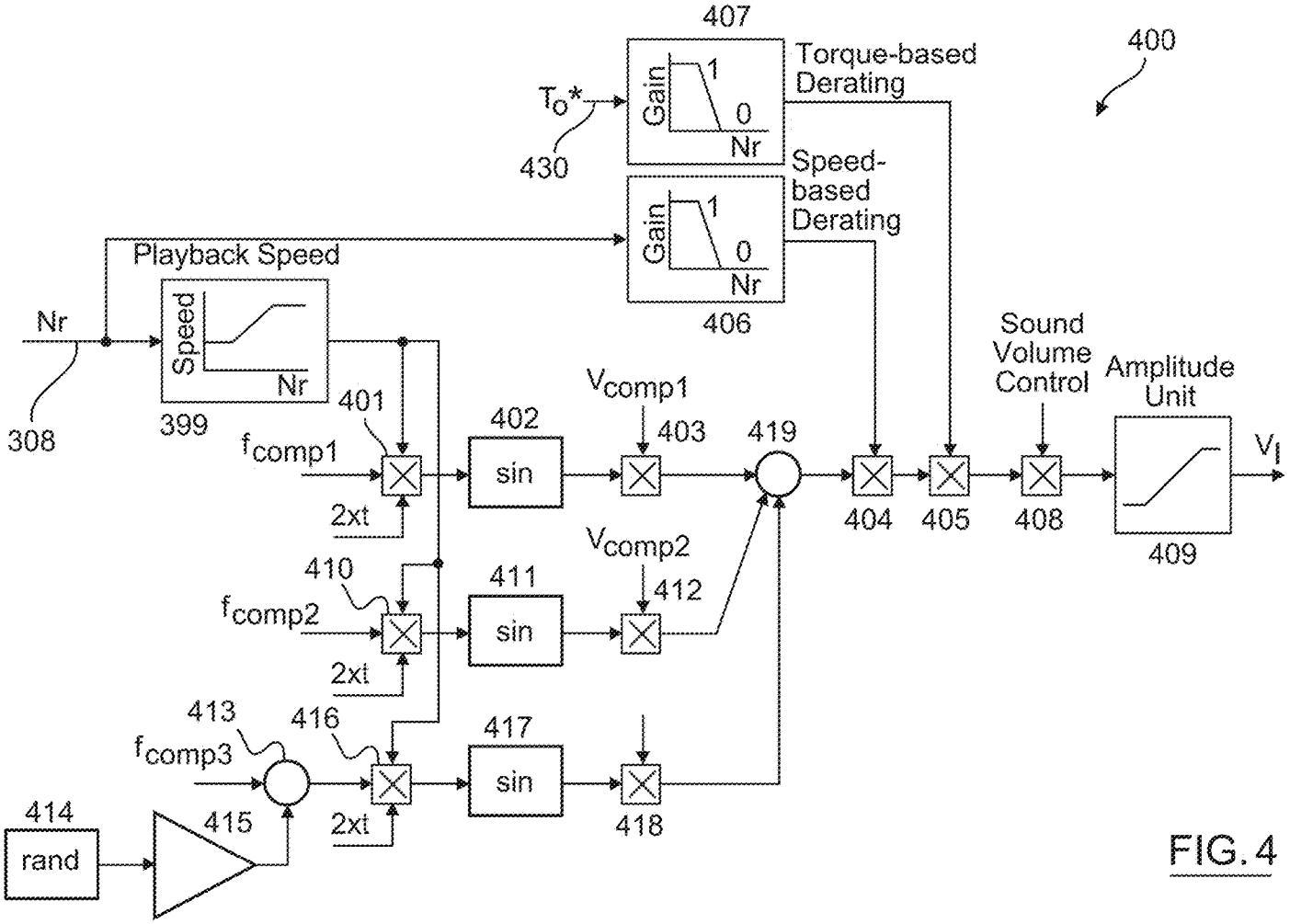
FIG. 4 is a block diagram of a process for masking vehicle sound, and that can be used in connection with the motor drive system and vehicle of FIG. 1 and the components of FIGS. 2 and 3, in accordance with exemplary embodiments.

FIG. 4 is a block diagram of a process 400 for masking vehicle sounds, in accordance with exemplary embodiments. The process 400 can be implemented in connection with the vehicle 100, including the motor drive system 102 and components thereof of FIGS. 2 and 3, in accordance with exemplary embodiments. The process 400 is also discussed further below in connection with FIGS. 5-7, which provide graphical representations of an exemplary case study of sound masking utilizing the techniques of the motor drive system and vehicle of FIGS. 1-3 and the process of FIG. 4, including the use of dithering techniques (FIG. 5); complementary tones (FIG. 6), and combinations thereof (FIG. 7), in accordance with exemplary embodiments. The process 400 is also discussed further below in connection with FIG. 8, which provides a graphical representation of exemplary test results using sound masking utilizing the techniques of the motor drive system and vehicle of FIGS. 1-3, in accordance with exemplary embodiments.

In various embodiment, the process 400 may be initiated any time when the vehicle 100 encounters a tonal noise issue. In certain embodiments, the process 400 continues throughout the vehicle drive, or as long as the tonal noise issue is present.

In various embodiments, the process 400 masks vehicle noises, such as relatively high pitch tonal noises from the motor 110 of FIG. 1 (e.g., from an electric motor) that could otherwise be uncomfortable for a driver or other user of the vehicle, and that could otherwise raise possible sound quality issues for electrified propulsion systems. Also in various embodiments, in general, the process 400 (*i*) controls the motor 110 (e.g., an electric motor) in order to create complementary low order tones to enrich sound complexity and achieve distraction of high pitch tonal noise targets; (ii) controls the motor 110 to generate random dithering noise to raise masking noise floor around tonal targets and reduce tone-to-noise ratio for active masking; (iii) combines both complementary injection (at low freq/rpm) and dithering (at high freq/rpm) for effective masking; and (iv) enables control of masking noise level, frequency, order and bandwidth as a function of motor torque/rpm for effective masking.

With continued reference to FIG. 4, an exemplary implementation of the process 400 for the proposed active masking technology using a motor-based acoustic generator is provided. In various embodiments, block 399 of FIG. 4, the playback speed of the sound is determined as a function of motor speed $N_r$, which is received as input 308 from FIG. 3 (e.g., from one or more motor sensors of the sensor array 121 of FIG. 1, for from one or more motor commands from the processor 122 of FIG. 1, or the like, in various embodiments).

In various embodiments, one or more tonal sounds are created at block 403. In certain embodiments, a single tonal sound is generated at block 403. However, this may vary in other embodiments. Also in certain embodiments, the tonal sound(s) at block 403 comprise one or more complementary tones to help with masking one or more vehicle and/or motor sounds for which masking may be desired. Also in various embodiments, a sinusoidal signal generator 402 obtains the input from the playback speed $K_n$, and a predetermined frequency $f_{comp1}$ and angle corresponding to the time "t" via operator 401, in accordance with Equation (2) below:

$$V_1 = V_{comp1} \sin(K_n \cdot f_{comp1} \cdot 2\pi t) \tag{2}$$

Similarly, in various embodiments, a second tonal sound at block 412 can be obtained from blocks 410 and/or 411. Also in certain embodiments, the tonal sound(s) at block 412 comprise one or more complementary tones to help with masking one or more vehicle and/or motor sounds for which masking may be desired. In certain embodiments, in FIG. 4, only two complementary tonal sounds are shown (i.e., at 403 and 412). However, in various other embodiments, additional tonal sounds can be added as needed. In various embodiments, at block 419, the output of each tonal sound source is collected and summed. In various embodiments, the tonal sounds are used to create the complementary tones.

In various embodiments, the sound from block 418 is used to create the dither sound. In various embodiments, a random number generator 414 generates a number between −1 and 1, and the output is multiplied with ½ $f_{span}$ at operator 415, which creates the frequency variation between −½$f_{span}$ and +½$f_{span}$. In various embodiments, the output of operator 415 is combined with center frequency inputs at operator 413, to generate an updated frequency at operator 416. Also in various embodiments, this frequency is then dithered (Δf) at operator 413, and is added to the center frequency $f_{center}$ for the input of the sine signal generator 417. Later, the output is multiplied with the amplitude $V_{dither}$, and added in block 419. The summed output at block 419 goes through controlled amplifier 404 and 405 to adjust the sound volume as a function of the motor speed and torque. Block 408 is used to scale the overall sound volume to the voltage for the final implementation, and block 409 limits the final output voltage. Later, the output of block 409 goes to the input of block 312 in FIG. 3, to be blended in the motor control.

In certain embodiments, torque-based derating is provided at block 407, using a motor torque value 430 as an input. In various embodiments, during block 407, the motor torque value 430 is utilized to generate a torque-based gain, resulting in torque-based derating of the motor sound as provided as an output to block 405.

Also in certain embodiments, speed-based derating is provided at block 406, using the motor speed 308 as an input. In various embodiments, during block 406, the motor speed value 308 is utilized to generate a speed-based gain, resulting in speed-based derating of the electric motor sound as provided as an output to block 404.

With continued reference to block 419 and the preceding blocks feeding into block 419, the steps utilized to determine the complementary tones and dither tones are explained in further detail below.

First, in various embodiments, at steps 413-416, the dithering frequency is defined in span to be wider than Critical Bandwidth (CB) for effective masking of high pitch tones at center frequency. Estimate Critical Bandwidth of auditory filter use Moore's empirical model for ERB (Equivalent Rectangular Bandwidth), such as in B. Moore's publication entitled "Frequency analysis and Masking, Chapter 4", in Handbook of Perception and Cognition, $2^{nd}$ Edition, Academic Press, 1995, p. 176, incorporated by reference herein. For instance, in order to mask 72nd order motor whine at 1500 rpm, the CB of 1.8 kHz center frequency is estimated to be 219 Hz. The dithering frequency span is created to cover the entire CB.

Second, also in various embodiments, at steps 416-418, the dithering magnitude level is defined in accordance with requirements using Critical Masking Ratio (CMR) curve. For instance, estimate the CMR about 17 dB for tonal frequency of 1.8 kHz (72nd order at 1500 rpm) using known reference curves, such as in Kinsler & Frey's published article "Fundamentals of Acoustics", J. Wiley & Sons, 1962, at p. 412, incorporated by reference herein. In various embodiments, the motor is controlled via dithering in order to generate random dithering noise to raise the floor around tonal targets and to reduce the tone-to-noise ratio for active masking (i.e., to mask the tone).

Figure 5:
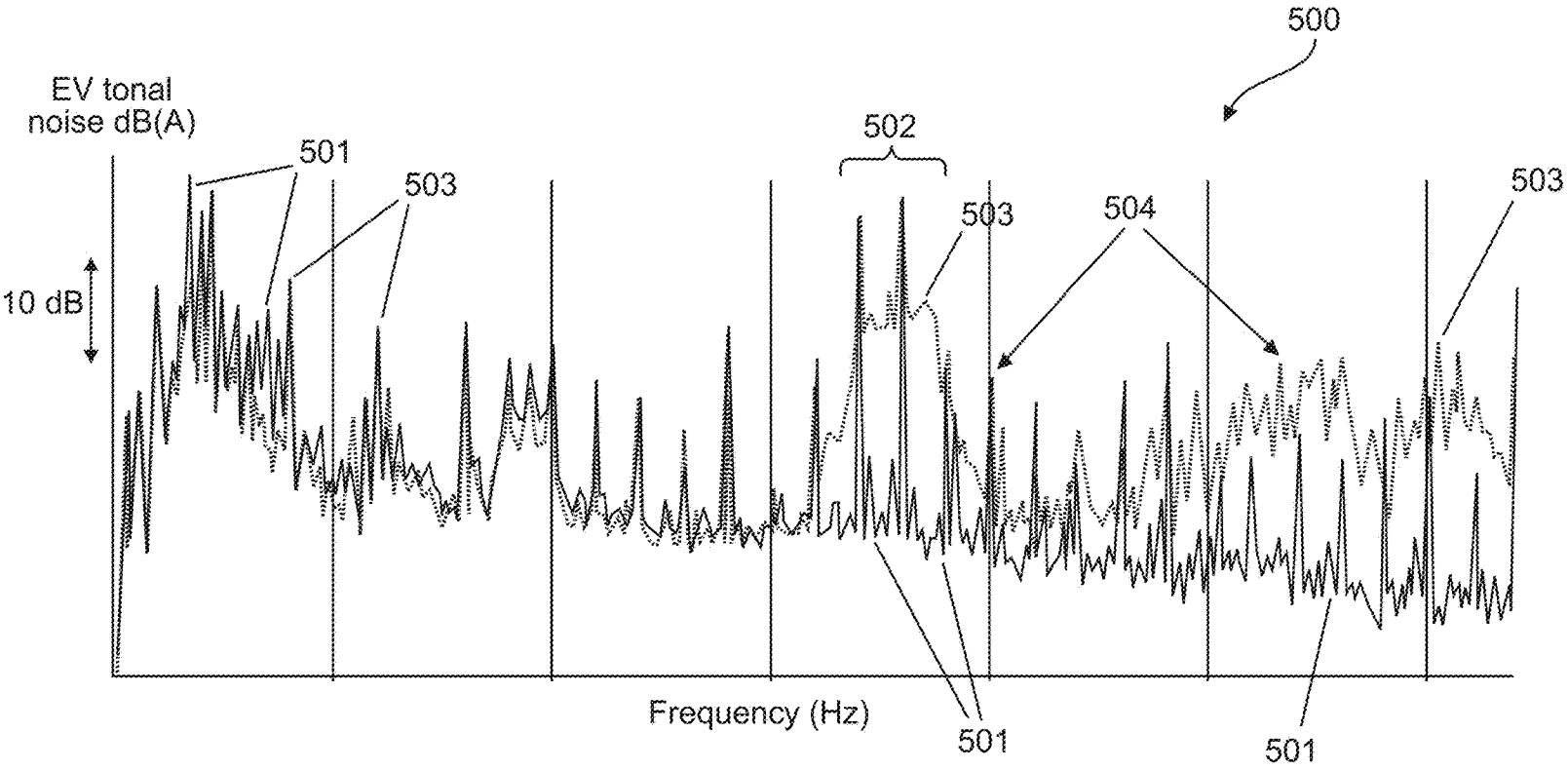
FIGS. 5-7 are graphical representations of an exemplary case study of sound masking utilizing the techniques of the motor drive system and vehicle of FIG. 1 and components of FIGS. 2 and 3, and the process of FIG. 4, including the use of dithering techniques (FIG. 5); complementary tones (FIG. 6), and combinations thereof (FIG. 7), in accordance with exemplary embodiments, for sound masking when the electric motor is operating at a specific exemplary speed and torque condition.

For example, with further reference to FIG. 5, a case study is provided to demonstrate the masking concept using vehicle noise measured at 3000 rpm with 90 Nm motor torque. Specifically, a graph 500 is provided, using frequency (in Hz) along the x-axis and sound (in Db) along the y-axis. The baseline noise (denoted in solid lines, at exemplary locations 501 of FIG. 5) in frequency domain shows high levels of potentially undesirable high pitch tonal noise proximate region 502 as represented in the graph 500 of FIG. 5, around $72^{nd}$ order (masking targets) between 3 to 4 kHz, which causes EV sound quality problems due to very little masking in this frequency range. In various embodiments, the dithered noise is denoted in dashed lines, at exemplary locations 503 of FIG. 5. In various embodiments, measured noise data associated with dithering of the motor (represented in region 504 of FIG. 5) raised noise floor around the masking targets (CB selected to be 600 Hz) by using the dithering technology with motor-based acoustic generator as explained above.

Third, also in various embodiments, at steps 401-412, complementary tones are defined as low-order overlapping-harmonics, for example as complementary music tones. For example, in certain embodiments, the same frequency ratio is utilized as a music major triad; 4th and 12th harmonics are selected for 8 pole Permanent Magnet motor) to produce a more consonant sound, and to distract from unpleasant high pitch tones. In various embodiments, this more complex sound masks the natural occurring single tone. For example, in certain embodiments, one or more complementary low-order harmonic sounds are used with respect to the motor tonal sound in order to enrich the sound complexity and achieve distraction of high pitch tonal noise targets.

Figure 6:
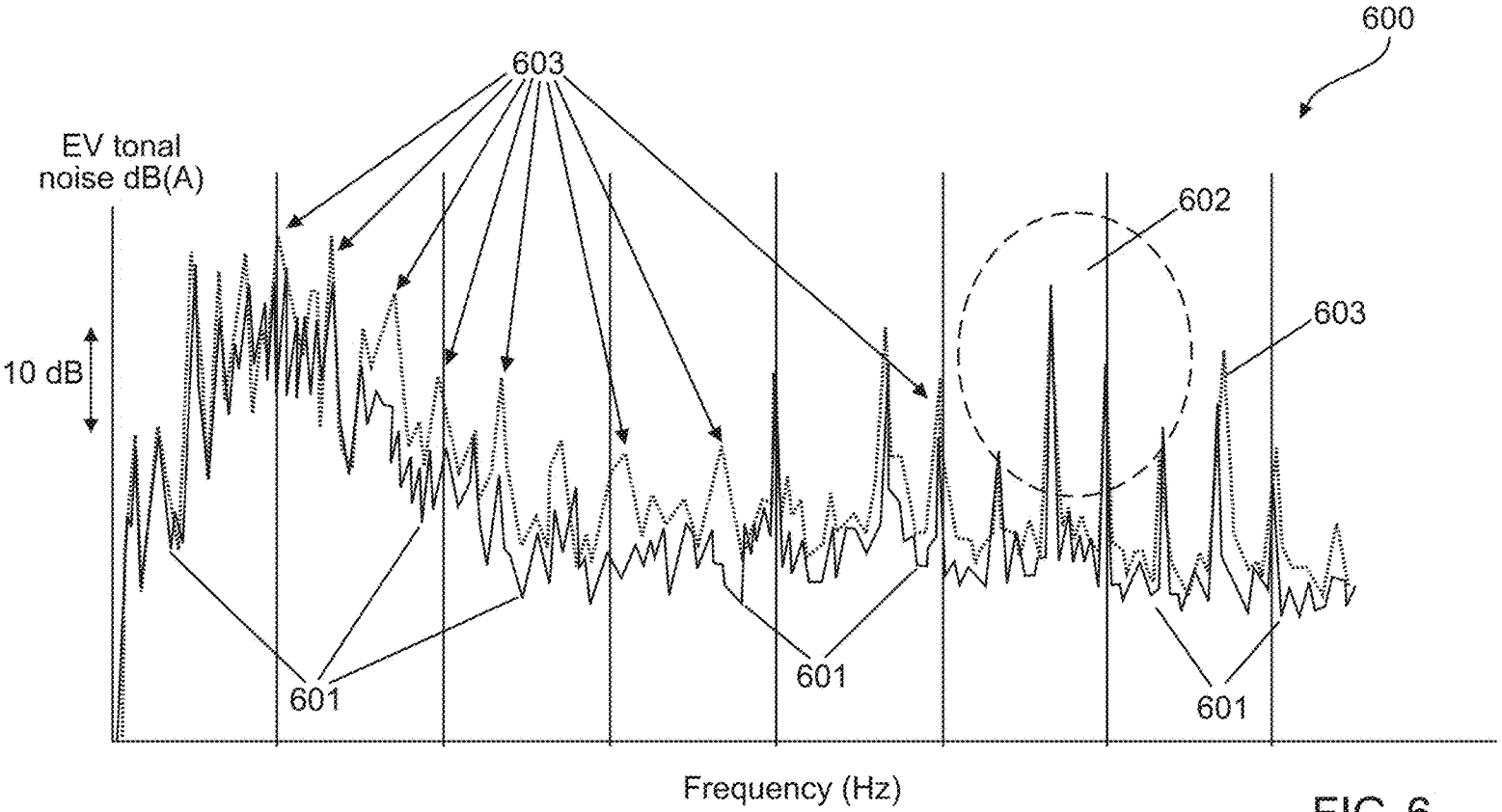

For example, with further reference to FIG. 6, a case study is provided that demonstrates the injection of $4^{th}$ and $12^{th}$ harmonics to mask a vehicle motor noise as distracting low order tones, with effectiveness confirmed by user tests. Specifically, a graph 600 is provided, using frequency (in Hz) along the x-axis and sound (in Db) along the y-axis. The baseline noise is denoted in solid lines, at exemplary locations 601 of FIG. 6, and include masking targets, for example as denoted in region 602 of FIG. 6. In various embodiments, the complementary sounds are denoted in dashed lines, at exemplary locations 603 of FIG. 6. In various embodiments, the complementary tones 603 (e.g., including the $4^{th}$ and $12^{th}$ harmonics with respect to the motor tonal noise that is desired to be masked) help to enrich the sound complexity and achieve distraction of high pitch tonal noise targets (e.g., the depicted tonal masking target 602 of FIG. 6).

Fourth, at steps 419, 404-409 voltage signals of dithering and/or complementary tones are injected at current regulator output. In certain embodiments, the dithering may be utilized instead of the complementary tones. In other embodiments, the complementary tones may be utilized instead of the dithering. In yet other embodiments, the dithering and complementary tones may be used together for maximum effectiveness. Accordingly, in various embodiments, the dithering and complementary tones can be activated individually or together to achieve the maximum masking of motor tonal noise targets pending feedback from motor/electric vehicle test results.

For example, with further reference to FIG. 7, a case study is provided that demonstrates both dithering and complementary tone techniques activated at the same time to achieve maximum masking of the high pitch tonal noise. Specifically, a graph 700 is provided, using frequency (in Hz) along the x-axis and sound (in dB) along the y-axis. The baseline noise is denoted in solid lines, at exemplary locations 701 of FIG. 7. In various embodiments, the dithered motor sounds are denoted in dashed lines in region 702 of FIG. 7 (i.e., on the right side of FIG. 7). Also in various embodiments, the complementary sounds are denoted in dashed lines in region 703 of FIG. 7 (i.e., on the left side of FIG. 7). In various embodiments, the dithered sounds 702 and the complementary sounds 703 work together to mask the tonal noise 701 and to provide a measure pleasing sound for the occupants inside the vehicle 100.

Fifth, in various embodiments, at step 406, a tracking of motor tonal orders is enabled by incrementing sound pitch as a function of motor speed 308 (for example, as discussed above in connection with step 406). In various embodiments, harmonic injection frequency and bandwith are both defined proportional to the motor speed, and thus this allows for the tracking of a specific tonal noise order at varying operating speeds of the motor vehicle.

Sixth, in various embodiments, an identification is made as to a minimum voltage injection (e.g., using available voltage without disturbing motor control) to achieve tonal masking and reduce motor efficiency loss. In accordance with various embodiments, the available voltage control is shown by the Amplitude Limit of 409.

For example, with further reference to FIG. 8, graphical representations are provided of exemplary test results using sound masking utilizing the techniques of the motor drive system and vehicle of FIG. 1 and components of FIGS. 2 and 3, the process of FIG. 4, and the implementations of FIGS. 5-7, in accordance with exemplary embodiments. In various embodiments, the graphical representations of FIG. 8 compare measured vehicle cabin noise data before and after both dithering and commentary tones injected over the 0 to 60 mph drive-away event. Specifically, in various embodiments, first graph 802 shows baseline motor noise levels for a vehicle, for example an electrical vehicle (with motor revolutions per minute on the x-axis and frequency, in Hz, on the y-axis). Second graph 804 shows revised motor noise levels for a vehicle, for example an electrical vehicle (with motor revolutions per minute on the x-axis and frequency, in Hz, on the y-axis).

In the example of FIG. 8, dither noises were created at region 803 to raise the noise floor around $72^{nd}$ tonal target. In addition, also as shown in FIG. 8, low order harmonics at $4^{th}$ and $12^{th}$ orders are also injected as complementary tones at region 804 to distract passengers' attention of the high pitch noise. In addition, it is noted that user test results confirm effectiveness of active masking: (i) 93.3% (14 out of 15) feel difference before and after injection; (ii) 86.7% (13 out of 15) feel injection makes motor noise less tonal/sharp; (iii) 73.3% (11 out of 15) feel injection improves sound quality (i.e., less displeasing).

Accordingly, the systems, vehicles, and methods described herein provide for masking of vehicle noises. In various embodiments, complementary tones, dithering of tonal noises, or both are utilized for masking certain vehicle tonal noises, for example in order to provide an improved experience for the driver and/or other users of the vehicle.

It will be appreciated that the disclosed methods, systems, and vehicles may vary from those depicted in the Figures and described herein. For example, the vehicle 100, the motor driver system 102, and/or various components thereof may vary from that depicted in FIGS. 1-3 and/or described in connection therewith. In addition, it will be appreciated that certain steps of the process 400 may vary from those depicted in FIG. 4 and/or described above in connection therewith. It will similarly be appreciated that certain steps of the methods described above may occur simultaneously or in a different order than that depicted in FIG. 4 and/or described above in connection therewith. It will similarly be appreciated that the various implementations of FIGS. 5-8 may also differ from those depicted in FIGS. 5-8 may differ from those depicted therein and/or described herein, and so on.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method comprising:

identifying a tonal noise of a motor of a vehicle;

generating complementary tones with respect to the tonal noise, the complementary tones comprising low-order overlapping harmonics with respect to the tonal noise; and masking the tonal noise, by introducing the complementary harmonic tones, including the low-order overlapping harmonics with respect to the tonal noise, using the motor as a speaker to create the complementary harmonic tones, including the low-order overlapping harmonics with respect to the tonal noise.

2. The method of claim 1, wherein the step of masking the tonal noise further comprises injecting dithering into the motor.

3. The method of claim 2, wherein the step of injecting dithering into the motor further comprises:

injecting dithering into the motor, thereby increasing a noise floor for the motor and decreasing a tone-to-noise ratio for the motor at the same time as the introducing of the harmonic tones, including the low-order overlapping harmonics with respect to the tonal noise.

4. The method of claim 1, wherein the step of masking the tonal noise further comprises:

introducing a complementary harmonic control signal voltage for the motor for the motor to generate the harmonic tones, including the low-order overlapping harmonics with respect to the tonal noise.

5. The method of claim 1, further comprising:

incrementing a sound pitch for the tonal noise as a function of motor torque.

6. The method of claim 1, wherein the complementary tones comprise complementary music tones.

7. The method of claim 6, wherein the complementary tones are generated using a same frequency ration as a music major triad.

8. The method of claim 7, wherein the complementary tones comprise fourth and twelfth harmonics with respect to the tonal noise.

9. A system comprising:

a motor generating a tonal noise; and an active masking acoustic signal generator (AMAG) configured to at least facilitate:

generating complementary tones with respect to the tonal noise, the complementary tones comprising low-order overlapping harmonics with respect to the tonal noise; and masking the tonal noise, by introducing the complementary harmonic tones, including the low-order overlapping harmonics with respect to the tonal noise, including the low-order overlapping harmonics with respect to the tonal noise.

10. The system of claim 9, wherein the AMAG is further configured to at least facilitate masking the tonal noise by injecting dithering into the motor at the same time as the introducing of the harmonic tones, including the low-order overlapping harmonics with respect to the tonal noise.

11. The system of claim 9, wherein the complementary tones comprise complementary music tones.

12. The system of claim 9, wherein the AMAG is configured to generate the complementary tones using a same frequency ration as a music major triad.

13. The system of claim 9, wherein the complementary tones comprise fourth and twelfth harmonics with respect to the tonal noise.

14. A vehicle comprising:

a drive system including a motor generating a tonal noise; and an active masking acoustic signal generator (AMAG) configured to at least facilitate:

generating complementary tones with respect to the tonal noise, the complementary tones comprising low-order overlapping harmonics with respect to the tonal noise; and masking the tonal noise, by introducing the complementary harmonic tones, including the low-order overlapping harmonics with respect to the tonal noise, including the low-order overlapping harmonics with respect to the tonal noise.

15. The vehicle of claim 14, wherein the AMAG is configured to at least facilitate masking the tonal noise by injecting dithering into the motor at the same time as the introducing of the harmonic tones, including the low-order overlapping harmonics with respect to the tonal noise.

16. The vehicle of claim 14, wherein:

the motor comprises an electric motor; and the vehicle comprises an electric vehicle or hybrid electric vehicle.

17. The vehicle of claim 14, wherein:

the AMAG comprises a processor onboard the vehicle; and the vehicle further includes a sensor array that is configured to at least facilitate identifying the tonal noise of the motor.

18. The vehicle of claim 14, wherein the complementary tones comprise complementary music tones.

19. The vehicle of claim 14, wherein the AMAG is configured to generate the complementary tones using a same frequency ration as a music major triad.

20. The vehicle of claim 14, wherein the complementary tones comprise fourth and twelfth harmonics with respect to the tonal noise.

* * * * *